United States Patent [19]

Schlesinger et al.

[11] Patent Number: 5,008,655

[45] Date of Patent: Apr. 16, 1991

[54] VISUAL ALARM DEVICE INTERCONNECTABLE TO EXISTING MONITORING CIRCUITRY

[76] Inventors: Robert A. Schlesinger, 1618 Vinewood La., NE., Cedar Rapids, Iowa 52402; Kimuel L. Hill, Rte. 2 - Box 200, Clinton, Tenn. 37716; Hamid S. Ali, 4946 Kebbe Dr., Sterling Heights, Mich. 48077; Mark E. Watson, 2209 Kline Ave., Nashville, Tenn. 37211

[21] Appl. No.: 438,083

[22] Filed: Nov. 20, 1989

[51] Int. Cl.[5] ..... G08B 21/00

[52] U.S. Cl. ..... 340/691; 340/635; 340/686

[58] Field of Search ..... 340/691, 643, 652, 635, 340/686

[56] References Cited

U.S. PATENT DOCUMENTS 3,432,841 3/1969 Harvey et al. ..... 340/635

4,520,354 5/1985 Umeda et al. ..... 340/691

4,533,905 8/1985 Leivenzon et al. ..... 340/686

4,535,325 8/1985 Marsh ..... 340/691

*Primary Examiner*—Glen R. Swann, III

*Attorney, Agent, or Firm*—Richard C. Litman

[57] ABSTRACT

A visual alarm device monitors the condition of a control and indication circuit and gives a distinct visual alarm upon detection of an abnormal condition in the monitored circuit. The device uses the indicator lights of the monitored circuit itself to give the visual alarm. The alarm device interconnects with the monitored circuit locally requiring no new cabling and remains in a passive state until an abnormal condition is detected. When the monitored circuit is rendered inoperative by a thermal overload trip, the alarm device becomes active to flash the indicator lights to provide a distinct visual alarm. Included in the device is a test switch, an appropriate voltage converter, an oscillator, and a power indication light.

6 Claims, 4 Drawing Sheets

VISUAL ALARM DEVICE INTERCONNECTABLE TO EXISTING MONITORING CIRCUITRY

BACKGROUND OF THE INVENTION

1. Field of the Invention

The present invention relates to electronic detection devices. More specifically, it relates to a device that can be interconnected with existing or new electrical control/indication circuits to monitor the continuity of circuits, without the need for additional cable or indicating devices, and to provide distinct indication of an abnormal condition. The control/indication circuits usually have an indication device comprised of indicating lights. The invention would, upon detection of an abnormal or open condition in the control circuit, provide a fixed oscillation frequency switching function in the existing indicator light(s) of the control/indication circuit to warn of the abnormal or open condition. When the control circuit is returned to normal state, the present invention will automatically reset. The device does not affect the control circuit being monitored under any condition.

The type of control/indication circuits addressed are those that would be present in various power production, chemical and other processes. There is a need to provide a means by which such control circuits can be monitored for an open Thermal Overload (TOL) relay contact condition. An open contact condition would render the control circuit inoperative. In some industries, it is critical to immediately identify and provide remote indication (at the control station) of an inoperative motor operated valve (MOV) control circuit (thus an inoperative valve) due to TOL trip. It is just as critical to provide continuous valve position indication if a TOL trip occurs. Different approaches have been taken to alert the operation personnel of this inoperative condition, but no one method provides a satisfactory solution to date. At best, various control/indication circuit design methods currently in use indicate, using separate alarm/indication circuits, loss of power to control circuits which could be due to other than a TOL trip condition.

In retrofit and in new circuits, design methods require additional indication and/or alarm circuits and cables between the MOV and control stations to provide positive indication of an abnormal condition. Circuit designs using existing indicating lights either do not provide a positive indication of an abnormal condition or they affect the ability of the lights to perform their original design intent (i.e. valve position indication).

At present, there does not appear to be any known single device;

(1) to detect and provide a distinct visual alarm, using existing indication lights in the circuit, when the control circuit is rendered inoperative due to an open contact;
(2) to test the device circuitry in its passive state (i.e. normal) without affecting the control and indication circuits;
(3) to provide device protection circuitry to separate it from the voltage of the monitored circuit;
(4) to provide light at the device to indicate power is available to the device in its passive state; and
(5) to provide distinct visual indication at the device when it is in its active state indicating an abnormal state of the monitored control circuit.

2. Description of the Prior Art

The following patents and inventors are felt to be related to, but do not disclose, either singly or in combination, the applicants' unique invention.

U.S. Pat. No. 1,725,022 issued to Stacey et al. discloses a voltage comparison system in which the alarm feature involves the lighting of a lamp should a problem arise.

U.S. Pat. No. 3,648,103 issued to Okada discloses an alarm system that comparatively measures an inputted voltage. An abnormal condition will cause a neon lamp to flash, thereby notifying an operator of the problem.

U.S. Pat. No. 4,247,849 issued to Morris et al. discloses an industrial plant alarm device that provides an LED indication of an unacceptable voltage problem.

U.S. Pat. No. 4,694,372 issued to Sibeud discloses an alarm system which measures the differences in voltage and provides a visual flashing alarm.

SUMMARY OF THE INVENTION

The present invention, hereafter called the "device", is interconnectable in the control/indication circuits within the Motor Control Center (MCC) to monitor an electrical control circuit. The device has means to detect or sense the status of the monitored control circuit (i.e. open or closed); and to indicate the status of the monitored control circuit using existing indicating lights without affecting the ability of the indicating lights to convey their original status function (e.g.: valve position). Thus, the existing indicating lights perform dual functions of valve indication in the normal state of the circuit, and TOL trip indication when the contact opens in the circuit while continuing to provide valve position indication.

The sensing circuit of the device comprises a sensing relay that detects an open contact of the monitored control circuit. The device has two modes of operation based upon the condition detected by its sensor. When interconnected in an electrical control/indication circuit, the passive state of the device is the one in which no open condition exists and the monitored control circuit is considered normal. An active state of the device is denoted when an open condition is detected in the monitored control circuit; and the control circuit is rendered inoperative (abnormal). The device's visual alarm function remains inactive in the passive state, but becomes active upon the detection of an open circuit, and distinctly affects the indication circuit.

The active state will provide immediate visual alarm to operations personnel that an inoperable condition exists within the control circuit. The device modulates the energized visual indicating light(s) of the indication circuit at a fixed frequency. Thus, the indicating light(s) provide both their intended status indication as well as the alarm indication of an inoperative control circuit. The device will automatically resume the passive state when the control circuit returns to the normal condition. The advantage here is that the device can use the indicating circuitry of the monitored control circuit to give a distinct visual indication, without having to introduce new control cables and separate indicating lights and/or alarms. The device has protection circuitry to separate itself from the control circuit. The device has a self-test switch and indicating light to periodically test the circuit of the device in the passive state.

Accordingly, one application of the device of the present invention is to provide distinct visual indication upon detection of an open (abnormal) condition in a monitored control circuit.

It is one object of the device of the present invention to be readily interconnectable in existing control/indication circuits.

Another object of this device is to sense an abnormal condition of a monitored control circuit.

Another object of this device is to provide a distinct visual alarm utilizing the existing indicating circuit of the monitored circuit without effecting the ability of the indicating circuit to convey its original design intent (to indicate valve open/close indication).

It is yet another object of the device of the present invention to automatically reset itself upon resumption of the circuit to normal condition.

It is another object of this device to provide both AC and DC embodiments (models) for AC and DC control circuit applications. Both AC and DC embodiment (model) descriptions are provided.

Another object of the present device is to provide the capability of built-in protection circuitry to separate itself from the voltage of the monitored circuit and to prevent itself from affecting the control circuit being monitored under any condition.

These and other objects of the present invention will become readily apparent upon review of the following specification and appended drawings.

BRIEF DESCRIPTION OF THE DRAWINGS

Like reference characters denote similar features throughout the drawings.

DESCRIPTION OF THE AC DEVICE EMBODIMENT

Figure 1:
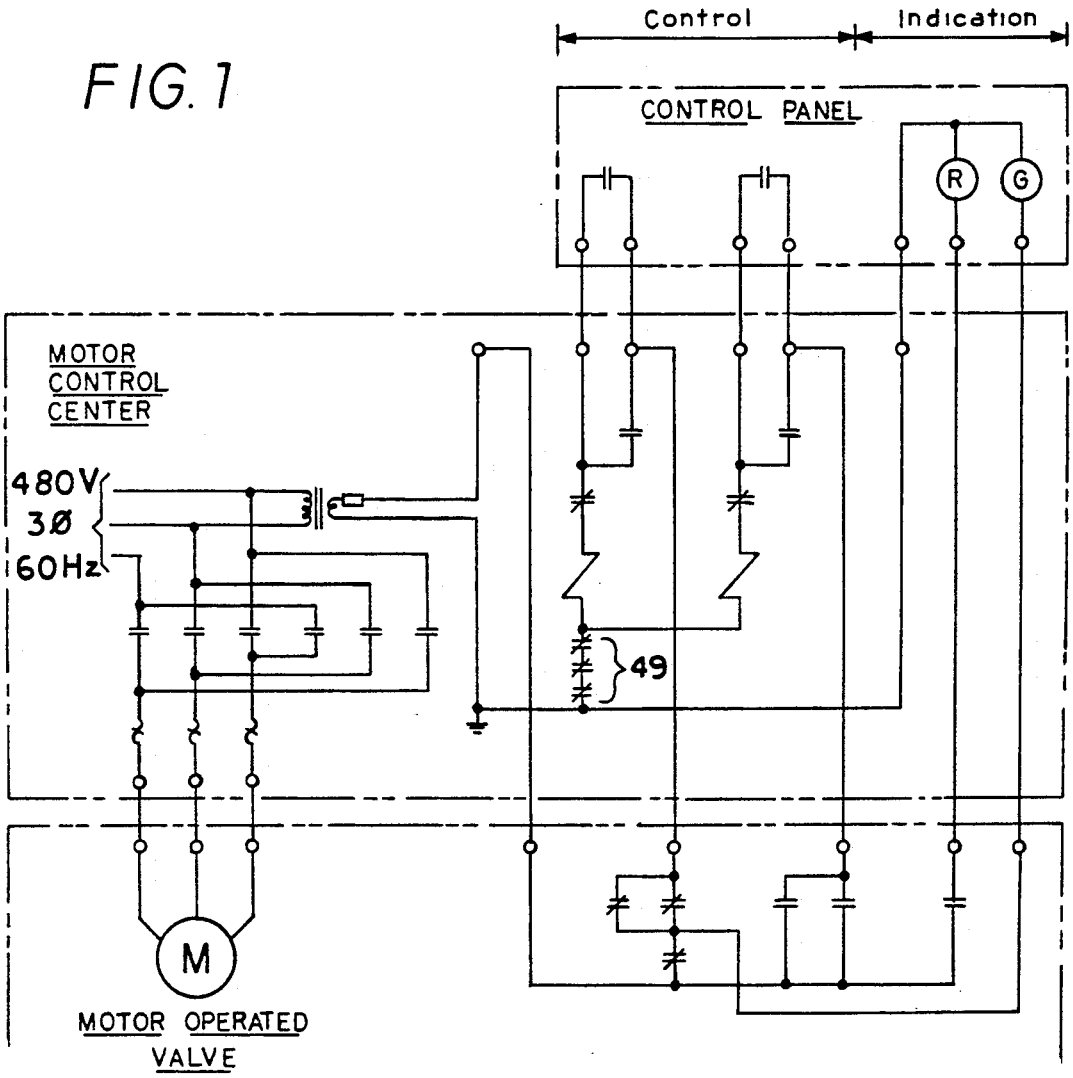
FIG. 1 shows a typical Motor Operated Valve (MOV) control and indication circuit schematic including the MCC.

FIG. 1 is a typical schematic diagram of a Motor Operated Valve (MOV) control and indication circuit in a process/industrial application. Indicating lights R and G (Red and Green) provide the valve open and close position indication, respectively. In the intermediate position of valve, both red and green lights are energized (ON). In the event of a Thermal Overload (TOL) trip, the control circuit of the MOV is rendered inoperative, but lights R and/or G will remain energized (depending on the position of the MOV at which the TOL trip occurred). Thus, no indication is provided when a TOL trip renders the MOV circuit inoperative. This inoperative condition of the MOV can remain undetected until an attempt is made to change the valve position.

Figure 2:
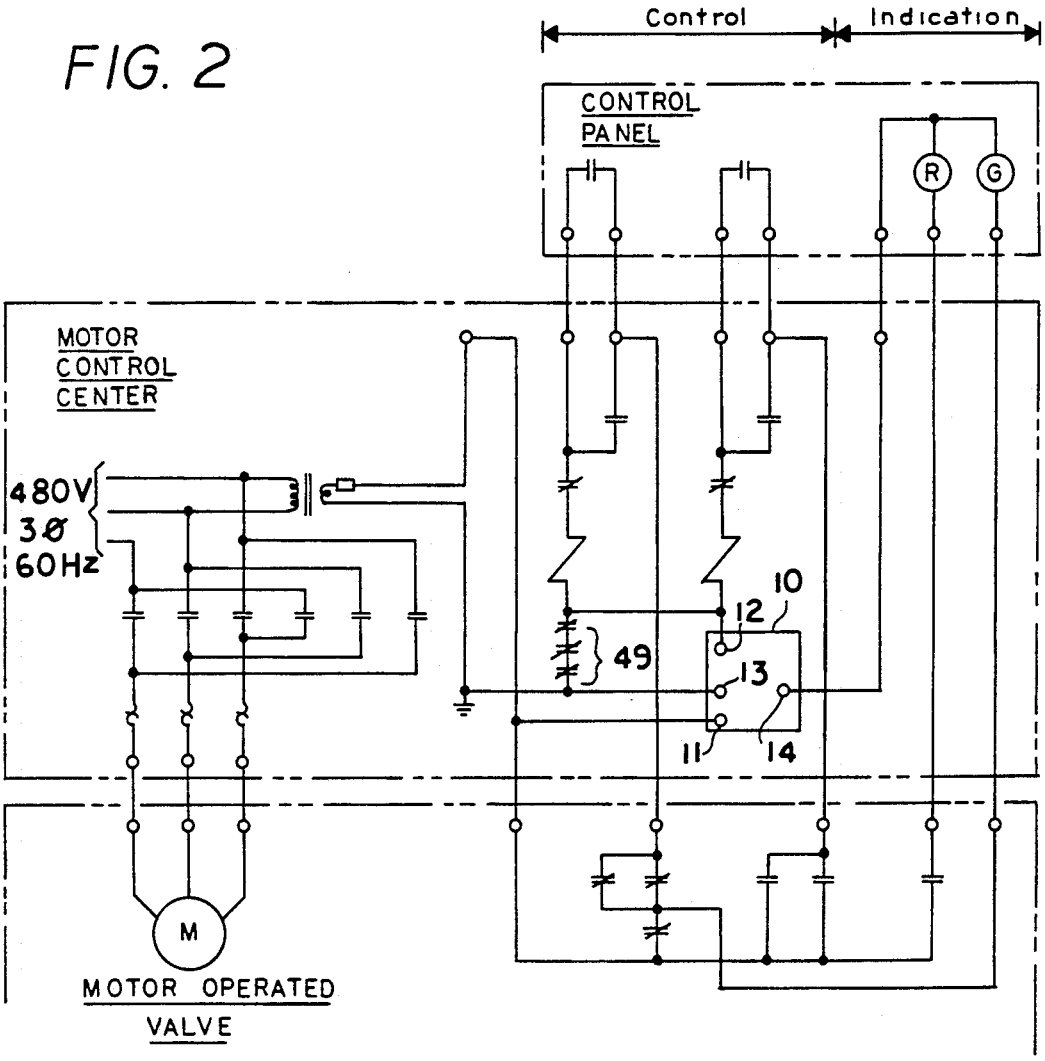
FIG. 2 shows the MOV control and indication circuit with the device interconnected in the MCC.

FIG. 2 shows the device 10 interconnected in FIG. 1, the MOV schematic discussed earlier. In the MOV control circuit (FIG. 2), the device is intended to monitor the TOL relay 49 contact in the control circuit and to provide distinct indication, using existing indicating lights R and G of the indication circuit of the MOV, when the control circuit is rendered inoperative due to an open 49 contact. Terminals 13 and 14 of the device 10 are connected in series with the indicating lights R and G of the MOV indication circuit. Terminal 11 provides AC power to the device. Terminal 12 is connected to the normally closed (N.C.) contact of the TOL relay 49. Terminal 12 connected to the 49 contact forms part of the sensing circuit in the device. The series circuit between terminals 13 and 14 forms part of the visual alarm circuit.

Figure 3:
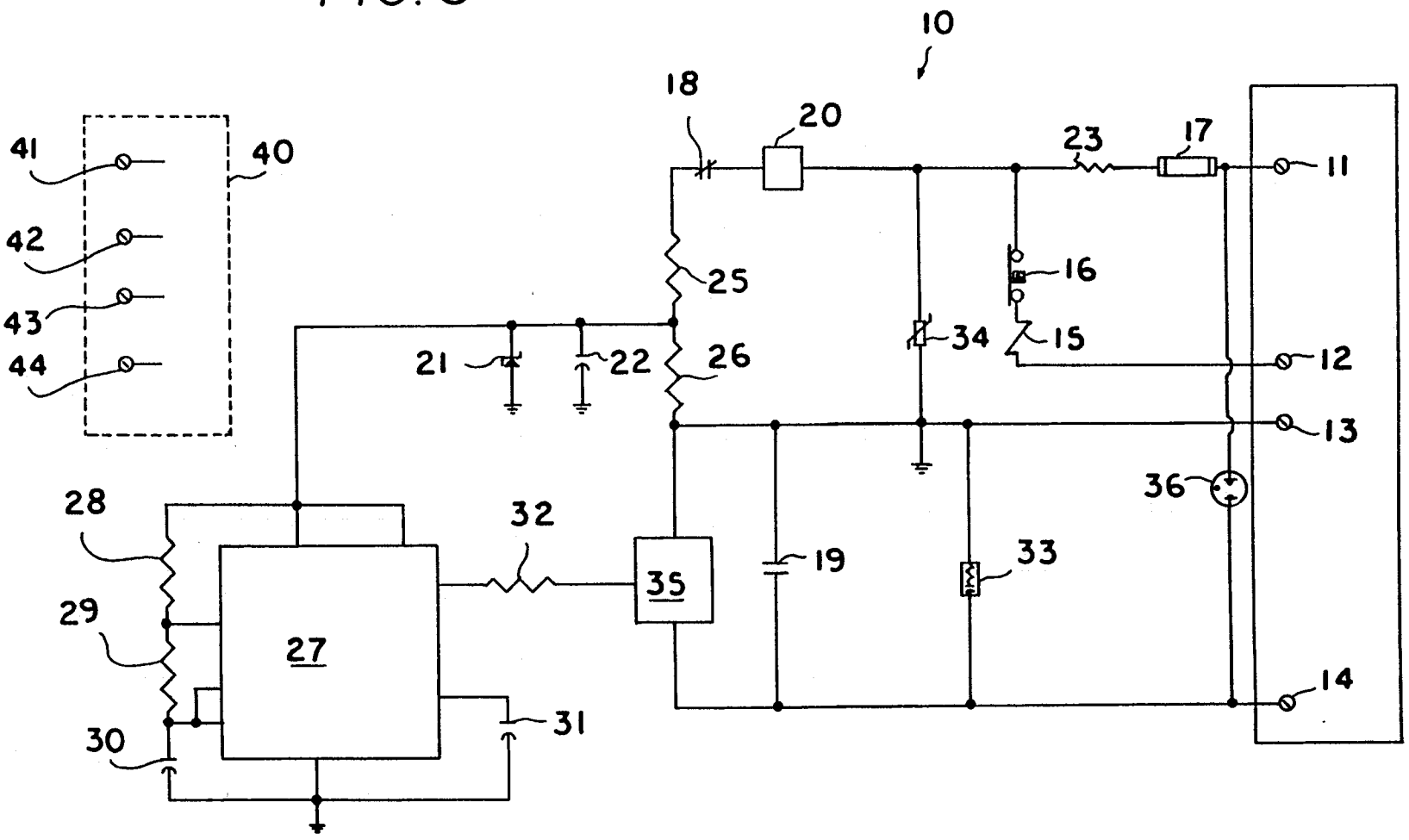
FIG. 3 shows a detailed circuit diagram of the present invention, the device for the AC model.

A detailed circuit of device 10 is presented in FIG. 3. Terminal 12, as stated before, is connected in series with the 49 contact. Sensing relay 15, test switch 16, dropping resistor 23, and fuse 17 are in series with each other. Relay 15 is normally energized when the 49 contact is closed. This signals that the device 10 and the control circuit of the MOV are in their normal state. This is the passive or inactive state of the device 10, which does not affect the control and indication circuit of the MOV. In the passive state, light 36 of the device is ON/energized to indicate power is available to the device.

Upon opening the 49 contact, the sensing relay 15 de-energizes, closing contact 18. When contact 18 closes, the device changes to its active state by applying control circuit voltage to the remaining circuit components. The AC voltage is half-wave rectified by device 20 and is then divided by resistors 25 and 26 to reduce the input to an acceptable level for the alarm circuit components. A filter capacitor 22 is used to provide a smooth DC output. Components 20, 22, 25, and 26 comprise the DC power supply of the device. A zener diode 21 serves to limit the voltage from the DC power supply to a maximum allowable value. The DC voltage is then used to power a 555-type timer chip 27. The timer 27 gives a digital output signal with a set frequency. Resistors 28,29 and capacitors 30,31 determine the set output frequency. The output signal from timer 27 passes through a current-limiting resistor 32 to the control device 35.

Finally, the control device 35 functions as a switch in the interconnected indication circuit with indicator lights R and G. During the passive state, contact 19 is closed and connected in parallel with control device 35. In the active state, contact 19 opens to insert control device 35 in series with the load. The rating of the contact and control device 35 provides for series-connected loads in excess of 2 amps. Timer 27 provides open and close signals in a pulsed fashion to the control device 35, causing energized indicating light(s) R and/or G to vary their illumination intensity on a cyclic basis. Setting the timer to an oscillation frequency of 4 cycles a second would be an appropriate timing rate with a nominal duty cycle of 50 percent. Indicating light 36 of the device provides distinct visual indication locally at the device.

Other features of the device 10 include test switch 16, which insure that the device 10 is itself in functioning order. Light 36 is connected within the device in such a manner that it will flash when the indicating lights of the control circuit are flashing and will remain illuminated during the device's passive state to indicate power is available to the device. Component 34 protects relay 15 from incoming voltage spikes, while resistor 23 is a dropping resistor for component 34. Component 33 protects component 35 from potential inductive kick through terminals 13 and 14.

The following is a table listing the various component reference numbers noted in the drawings and their values.

TABLE 1

| Component # | Value | Design Limits/Type |
|---|---|---|
| 15 | 120 V AC | Relay four contacts |
| 16 | Single-Contact | push-button |
| 17 | 0.5 Amp | Fuse |
| 20 | Half-Wave | Rectifier |
| 21 | 18 Volt | Zener |
| 22 | 470 uF | 25 V |
| 23 | 100 ohms | 1.0 watt |
| 25 | 8.0 K ohms | 5.0 watt |
| 26 | 6.2 K ohms | 1.0 watt |
| 27 | 555 timer | |
| 28 | 1.0 K ohms | 0.25 watt 1% |
| 29 | 158 K ohms | 0.25 watt 1% |
| 30 | 1.0 uF | 50 V |
| 31 | 0.1 uF | 50 V |
| 32 | 1.0 K ohms | 0.25 watt 1% |
| 33 | .047 uF/ohms | RC network |
| 34 | 150 V | Metal Oxide Varistor |
| 35 | 2.5 Amp | Triac |
| 36 | Neon | Lamp |

The device 10 may be interconnected, by means of an auxiliary external terminal board 40, with multiple control and indication devices. Terminals 41–44 are spare contacts of relay 15 for inputs to other circuits, if needed.

DESCRIPTION OF THE DC DEVICE EMBODIMENT

The description for FIGS. 1 and 2 are sufficiently similar for DC MOV control and indication circuits that the description for the AC device embodiment may be used in lieu of restating the operation.

Figure 4:
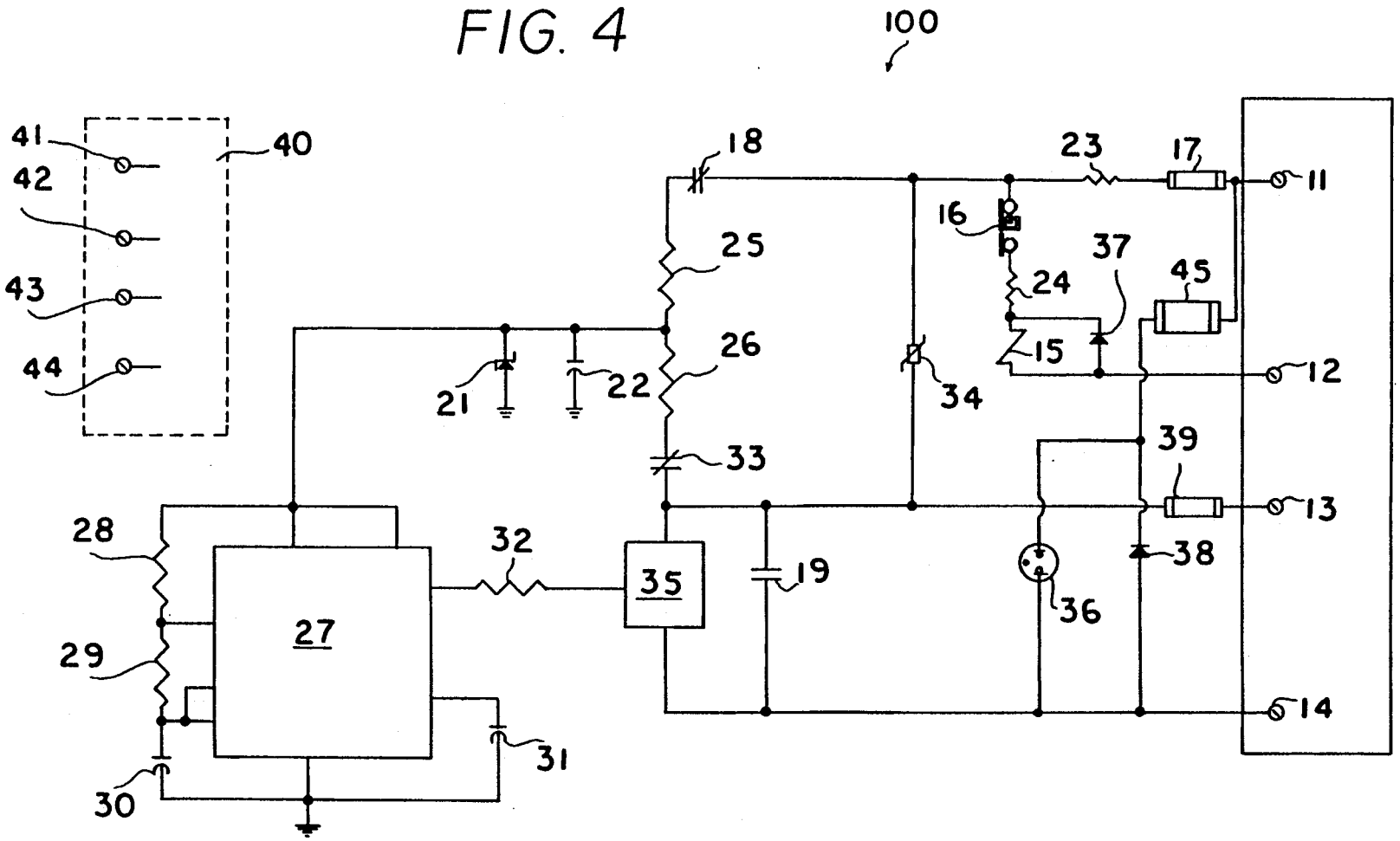
FIG. 4 shows a detailed circuit diagram of the present invention, the device for the DC model.

A detailed circuit of device 100 is presented in FIG. 4. Terminal 12, as stated before, is connected in series with the 49 contact. Sensing relay 15, test switch 16, dropping resistors 23,24, and fuse 17 are in series with each other. Relay 15 is normally energized when the 49 contact is closed. This signals that the device 100 and the control circuit of the MOV are in their normal state. This is the passive or inactive state of the device 100, which does not affect the control and indication circuit of the MOV. In the passive state, light 36 of the device is ON/energized to indicate power is available to the device.

Upon opening the 49 contact, the sensing relay 15 de-energizes, closing contacts 18 and 33. When contacts 18 and 33 close, the device changes to its active state by applying control circuit voltage to the remaining circuit components. The voltage is then divided by resistors 25 and 26 to reduce the input to an acceptable level for the alarm circuit components. A filter capacitor 22 is used to provide a smooth DC output. Components 22,25,26 comprise the DC power supply of the device. A zener diode 21 serves to limit the voltage from the DC power supply to a maximum allowable value. The DC voltage is then used to power a 555-type timer chip 27. The timer 27 gives a digital output signal with a set frequency. Resistors 28,29 and capacitors 30,31 determine the set output frequency. The output signal from timer 27 passes through a current-limiting resistor 32 to the control device 35.

Finally, the control device 35 functions as a switch in the interconnected indication circuit with indicator lights R and G. During the passive state, contact 19 is closed and connected in parallel with control device 35. In the active state, contact 19 opens to insert control device 35 in series with the loads. The rating of the contact and control device 35 provides for series-connected loads in excess of 2 amps. Timer 27 provides open and close signals in a pulsed fashion to the control device 35, causing energized indicating light(s) R and/or G to vary their illumination intensity on a cyclic basis. Setting the timer to an oscillation frequency of 4 cycles a second would be an appropriate timing rate with a nominal duty cycle of 50 percent. Indicating light 36 of the device provides distinct visual indication locally at the device.

Other features of the device 100 include test switch 16, which insure that the device 100 is itself in functioning order. Opening test switch 16 activates the alarm sequence as described above. Light 36 is connected within the device in such a manner that it will flash when the indicating lights of the control circuit are flashing and will remain illuminated during the device's passive state to indicate power is available to the device. Component 34 protects relay 15 from incoming voltage spikes, while dropping resistor 23 protects component 34 and dropping resistor 24 reduces the voltage to an acceptable level for component 15. Component 37 protects component 15 from potential inductive kick when it de-energizes. Component 38 protects component 35 from potential inductive kick from components in the external circuit. Fuse 39 is provided to protect against an accidental short of the negative power line. Fuse 45 protects against a possible short in device 38. Table 2 lists the various component reference numbers noted in the drawings, and their values.

TABLE 2

| Component # | Value | Design Limits/Type |
|---|---|---|
| 15 | 110 V AC | Relay four contacts |
| 16 | Single-Contact | push-button |
| 17 | 0.5 Amp | Fuse |
| 21 | 18 Volt | Zener |
| 22 | 470 uF | 25 V |
| 23 | 100 ohms | 1.0 watt |
| 24 | 3.3 K ohms | 0.5 watt |
| 25 | 8.0 K ohms | 5.0 watt |
| 26 | 6.2 K ohms | 1.0 watt |
| 27 | 555 timer | |
| 28 | 1.0 K ohms | 0.25 watt 1% |
| 29 | 158 K ohms | 0.25 watt 1% |
| 30 | 1.0 uF | 50 V |
| 31 | 0.1 uF | 50 V |
| 32 | 1.0 K ohms | 0.25 watt 1% |
| 34 | 153 V | Metal Oxide Varistor |
| 35 | 2.5 Amp | Darlington Transistor |
| 36 | Neon | Lamp |
| 37 | Half-Wave | Rectifier |
| 38 | Half-Wave | Rectifier |
| 39 | 2.5 Amp | Fuse |
| 45 | 3.0 Amp | Fuse |

The device 100 may be interconnected, by means of an auxiliary external terminal board 40, with multiple control and indication devices. Terminals 41–43 are spare contacts of relay 14 for inputs to other circuits, if needed.

It is to be understood that the device of the present invention is not limited to the sole embodiment described above, but encompasses any and all embodiments within the scope of the following claims. This includes, but is not limited to, both AC and DC devices of varying voltages and varying applications as may be applicable.

We claim:

1. A visual alarm device readily interconnectable within a monitored circuit, said monitored circuit including a motor operated device;

a motor control center for controlling said motor operated device; and visual indicating devices for indicating the position of said motor operated device said visual alarm device comprising:

a condition-detecting circuit connected to said monitored circuit to detect a change of condition in said monitored circuit;

an oscillator responsive to said condition-detecting circuit, said oscillator providing a regular cyclic signal upon receiving a signal from said condition-detecting circuit; and a controller disposed in series with said visual indicating devices within said monitored circuit and responsive to said oscillator, said controller allowing current to cyclically flow between pole terminals of said visual indicating devices upon receiving said regular cyclic signal from said oscillator;

said visual alarm device thereby giving a distinct visual indication upon a change of condition in said monitored circuit using existing wiring between said motor control and said visual indicating devices.

2. The visual alarm device according to claim 1, wherein said condition-detecting circuit includes:

a normally energized condition-detecting relay with a normally open contact switch disposed between said condition-detecting relay and said oscillator.

3. The visual alarm device according to claim 2, including:

a normally closed test switch disposed in series with said condition-detecting relay, said test switch being openable to test the function of said visual alarm device.

4. The visual alarm device according to claim 2 said visual alarm device having a passive state and an active state and further including:

a further visual indicating device disposed between said condition-detecting relay and said normally open contact switch, said further visual indicating device giving indication that said visual alarm device is energized and operating properly in said passive state and in said active state, said further visual indicating device providing distinct visual indication at the device as well.

5. The visual alarm device according to claim 1 further including:

a voltage converter connected in series after said condition-detecting circuit to convert monitored circuit voltage to a DC voltage appropriate for device components.

6. A visual alarm device readily interconnectable within a monitored circuit, said monitored circuit including at least one visual indicating device said visual alarm device comprising a condition-detecting circuit connected to said monitored circuit to detect a change of condition in said monitored circuit;

an oscillator responsive to said condition-detecting circuit, said oscillator providing a regular cyclic signal upon receiving a signal from said condition-detecting circuit; and a controller responsive to said oscillator, said controller allowing current to cyclically flow between pole terminals of said at least one visual indicating device upon receiving said regular cyclic signal from said oscillator;

said visual alarm device thereby giving a distinct visual indication upon a change of condition in said monitored circuit using existing wiring in said monitored circuit.

* * * * *